US006186832B1

(12) United States Patent
Madden et al.

(10) Patent No.: US 6,186,832 B1
(45) Date of Patent: Feb. 13, 2001

(54) ADAPTER FOR INTERFACING A FLEX-TERMINAL RECEPTACLE TO A BARREL-TERMINAL RECEPTACLE

(75) Inventors: William T. Madden, Solon; Edward M. Bungo, Cortland, both of OH (US)

(73) Assignee: Delphi Technologies, Inc., Troy, MI (US)

( * ) Notice: Under 35 U.S.C. 154(b), the term of this patent shall be extended for 0 days.

(21) Appl. No.: 09/377,585

(22) Filed: Aug. 19, 1999

(51) Int. Cl.[7] ..... H01R 25/00
(52) U.S. Cl. ..... 439/638
(58) Field of Search ..... 439/638, 660, 439/680, 353, 357, 358, 365, 350

(56) References Cited

U.S. PATENT DOCUMENTS

| | | | | |
|---|---|---|---|---|
| 3,137,537 | * | 6/1964 | Cole et al. | 439/638 |
| 3,568,136 | * | 3/1971 | Wells | 439/638 |
| 5,697,815 | * | 12/1997 | Drewnicki | 439/638 |
| 6,033,265 | * | 3/2000 | Yeh | 439/638 |
| 6,042,425 | * | 3/2000 | Moller et al. | 439/638 |

* cited by examiner

*Primary Examiner*—Paula Bradley
*Assistant Examiner*—Tho D. Ta
(74) *Attorney, Agent, or Firm*—Richard A. Jones

(57) ABSTRACT

An adapter for interfacing, electrically and structurally, a flex-terminal receptacle to a barrel-terminal receptacle. The adapter has a first end configured as an inlaid pin terminal receptacle, and has a second end configured as a projecting pin terminal receptacle. The inlaid pin terminal receptacle includes a base plane having a plurality of pin slots having an inlaid pin forming thereat an inlaid pin terminal. Each pin slot is positioned so that the exposed contact surface thereof is interfaceable with the apex of a respective flex-terminal of a flex-terminal receptacle, and the dimension of the base plane is such as to interfit generally snugly within the flex-terminal receptacle. The projecting pin receptacle includes a shroud which is dimensioned to snugly receive therein a barrel-terminal receptacle, inclusive of the indexing tabs thereof. Each pin of each pin slot passes through a dividing wall of the adapter and therefrom projects as a projecting pin terminal within the shroud. Accordingly, when a barrel-pin receptacle is received into the shroud, each projecting pin terminal is received into the central bore of a respective barrel-terminal.

15 Claims, 5 Drawing Sheets

ADAPTER FOR INTERFACING A FLEX-TERMINAL RECEPTACLE TO A BARREL-TERMINAL RECEPTACLE

TECHNICAL FIELD

The present invention relates to flex-terminal receptacles having a plurality of flex-terminals, each characterized by a V-shape providing an electrical contact at an apex thereof which is intended for an electrical interface with an exposed contact surface of a pin terminal which is inlaid in a base plane. The present invention is further related to barrel-terminal connectors having a plurality of barrel-terminals, each characterized by an electrical contact in the form of a central aperture intended to electrically interface receivably with a freely projecting pin terminal. Still more particularly, the present invention is related to an adapter for interfacing the flex-terminals of a flex-terminal receptacle with the barrel-terminals of a barrel-terminal receptacle.

BACKGROUND OF THE INVENTION

Referring to FIGS. 1 and 3, a header assembly 10 is used to interconnect between a wiring harness connector (not shown) and a printed circuit board 12. The header assembly 10 is typically constructed of plastic (but could be of another material, such as aluminum), having a flex-terminal receptacle 14. Within the flex-terminal receptacle 14, a plurality of V-shaped, flatly configured flex-terminals 16 are provided, each being connected to a respective anchor pin 18. The flex-terminals 16, and their associated anchor pins 18, are arranged in two rows: an upper row 20 and a lower row 22 (see FIG. 12). By way of example (and not limitation), there are sixteen flex-terminals 16 to each of the upper and lower rows 20, 22, the flex-terminals rowably opposing each other. There is a predetermined distance D between the relaxed position of the apices 32 of rowably opposing flex-terminals 16, and there is a predetermined width W between of the inner faces 34, 36 of the flex-terminal receptacle.

At the rear side of the header assembly 10, the anchor pins 18 horizontally project to a predetermined bend location respectively for each of the upper and lower rows 20, 22, whereupon the anchor pins are vertically oriented and terminate at a common plane whereat they are anchored by solder to the printed circuit board 12. A mylar strip 26 serves as an anchor pin placement keeper prior to the anchor pins being anchored to the printed circuit board.

The flex-terminal receptacle 14 is configured to receive an inlaid pin terminal receptacle of a wiring harness characterized by a base plane having a plurality of inlaid pin terminals, each having an exposed contact surface that is interfaceable with an apex 32 of each flex-terminal. The header assembly 10 includes a pair of seats 28, 30, each for receiving a respective U-shaped guide member, having an associated lock arm, of the planar pin terminal receptacle, wherein the resilient lock arms serve to selectively lock the flex-terminal receptacle to the inlaid pin terminal receptacle.

In a typical "dock-and-lock" scenario of operation, the anchor pins 18 are firstly soldered to the PCB 12. Then, the flex-terminal receptacle 14 receives an inlaid pin terminal receptacle of a wiring harness having a plurality of inlaid pin terminals, wherein an exposed surface thereof slidably interfaces with the apex of a respective flex-terminal as the two receptacles are mated.

Quality assurance practices frequently require that the electrical component associated with the PCB 12, such as for example an instrument cluster, radio, heating/ventilating/cooling control, etc., be tested. Accordingly, the tester for performing the test must be interfaceable with the flex-terminal receptacle 14.

In conventional practice, testers 50, as shown at FIGS. 2 and 4, have a box-like configuration including a barrel-terminal receptacle 52 having a plurality of barrel-terminals 54 and a plurality of indexing ribs 62. The barrel-terminals 54 are arranged in upper and lower rows 56, 58, and have the same number of barrel-terminals per row as the flex-terminal receptacle 14 has flex-terminals per row (ie., sixteen). The barrel-terminal receptacle is intended to interface with a projecting pin receptacle having reciprocal indexing slots for receiving the indexing ribs 62, wherein a plurality of terminal pins freely project so as to be insertable into each barrel-terminal.

Direct electrical interface between a flex-terminal receptacle and a barrel-terminal receptacle is impossible because of the incompatible structures inherent to flex-terminals and barrel-terminals: the resilient V-shape configuration of flex-terminals presupposes that the apex thereof interface with respective inlaid pin terminals that are inlaid into a base plane so as to have an elongated exposed contact surface, whereas barrel-terminals have a central bore 60 which presupposes an interface with pin terminals that freely project so as to be receivable into the central bore.

Accordingly, what remains needed in the art is an adapter which interfaces a flex-terminal receptacle to a barrel-terminal receptacle.

SUMMARY OF THE INVENTION

The present invention is an adapter for interfacing, electrically and structurally, a flex-terminal receptacle to a barrel-terminal receptacle.

The adapter according to the present invention has a first end and a second end, wherein the first end is configured as an inlaid pin terminal receptacle, and the second end is configured as a projecting pin terminal receptacle.

The inlaid pin terminal receptacle includes a base plane having a plurality of pin slots formed thereon at the upper and lower sides thereof, wherein each pin slot is oriented axially (that is, oriented parallel to an axis passing through the adapter perpendicularly to each of the rear and front ends). Inaid in each pin slot is a pin, the pin for-ming thereat an inlaid pin terminal, wherein an exposed contact surface thereof lies at the respective upper or lower side of the base plane. Each pin slot is positioned so that the exposed contact surface thereof is interfaceable with the apex of a respective flex-terminal of a flex-terminal receptacle, and the dimension of the base plane is such as to interfit generally snugly within the flex-terminal receptacle.

The projecting pin receptacle includes a shroud which is dimensioned to snugly receive therein a barrel-terminal receptacle, inclusive of the indexing tabs. Each pin of each pin slot passes through a dividing wall of the adapter and therefrom projects as a projecting pin terminal within the shroud. Accordingly, when a barrel-pin receptacle is received into the shroud, each projecting pin terminal is received into the central bore of a respective barrel-terminal.

In a preferred form of the adapter, the first end includes a pair of flexible lock arms, each being flexibly situated in a U-shaped guide member, so that the adapter is lockable to the seats of a header assembly of a flex-terminal receptacle in a conventional manner.

With a flex-terminal receptacle mated to the inlaid pin terminal receptacle of the first end of the adapter, and with a barrel-terminal receptacle mated to the projecting pin terminal receptacle of the second end of the adapter, the flex-terminals of the flex-terminal receptacle are electrically connected to the barrel-terminals of the barrel-terminal receptacle.

Accordingly, it is an object of the present invention to provide an adapter which electrically and structurally interfaces a flex-terminal receptacle to a barrel-terminal receptacle.

It is an additional object of the present invention to provide an adapter which electrically and structurally interfaces a flex-terminal receptacle to a barrel-terminal receptacle, wherein the adapter is selectively lockable to a header assembly of the flex-terminal receptacle.

These, and additional objects, advantages, features and benefits of the present invention will become apparent from the following specification.

DESCRIPTION OF THE PREFERRED EMBODIMENT

Figure 1:
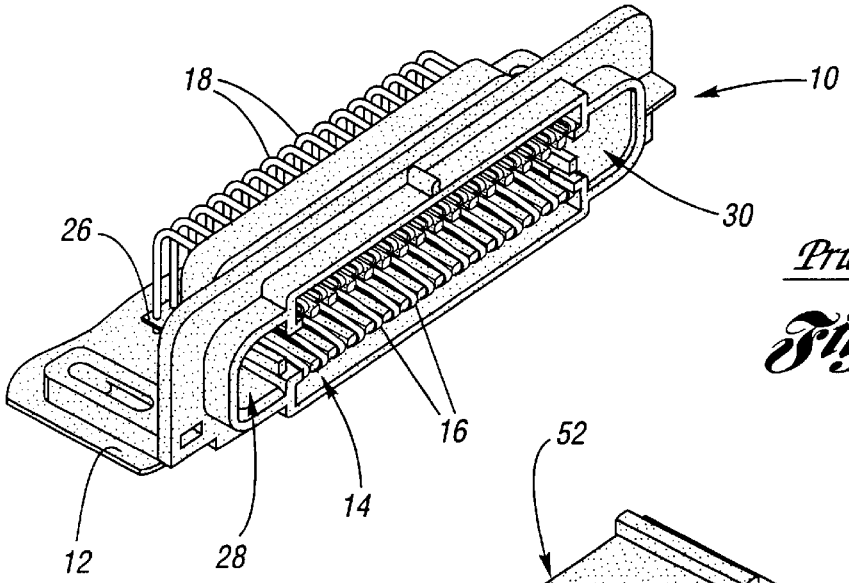
Prior Art Fig. 1
FIG. 1 is a perspective view of a prior art header assembly including a flex-terminal receptacle thereof.
Figure 2:
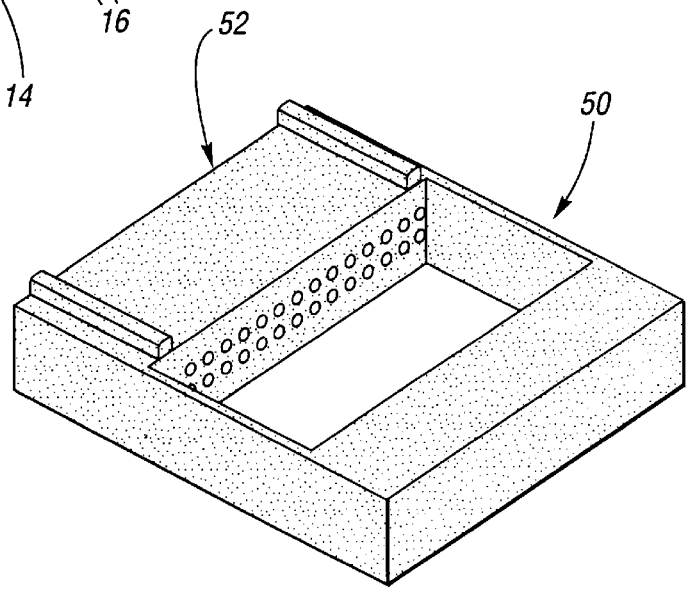
Prior Art Fig. 2
FIG. 2 is a perspective view of a prior art tester including a barrel-terminal receptacle thereof.
Figure 3:
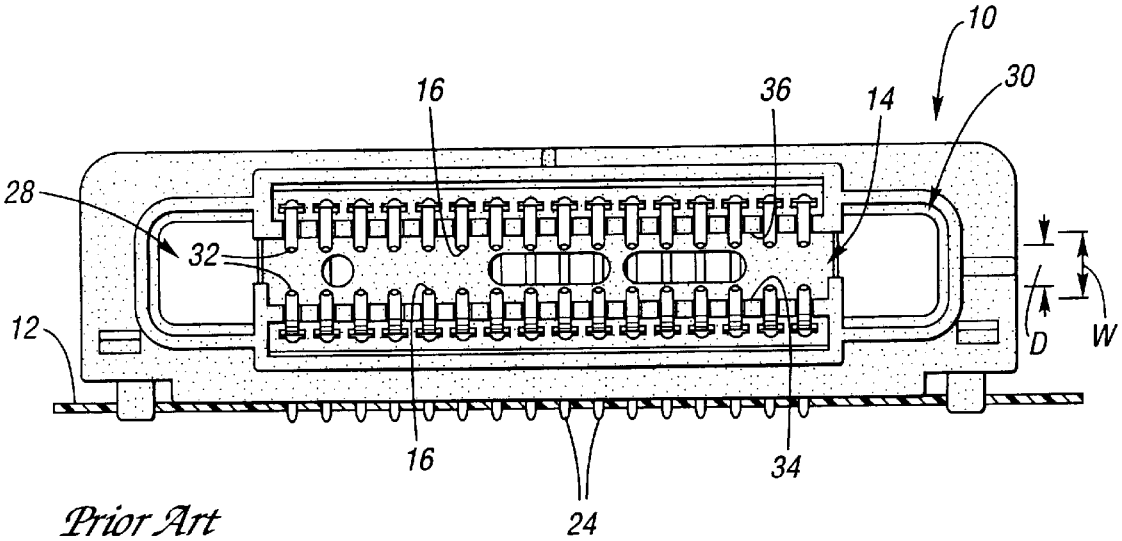
Prior Art Fig. 3
FIG. 3 is a front side view of the prior art flex-terminal receptacle shown at FIG. 1.
Figure 4:
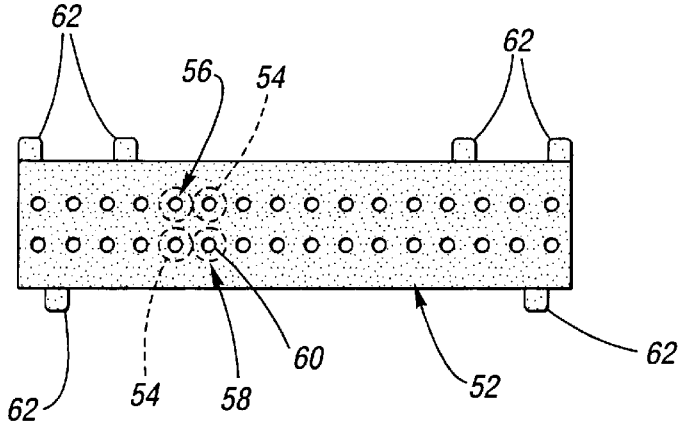
Prior Art Fig. 4
FIG. 4 is a front side view of the prior art barrel-terminal receptacle shown at FIG. 2.
Figure 5:
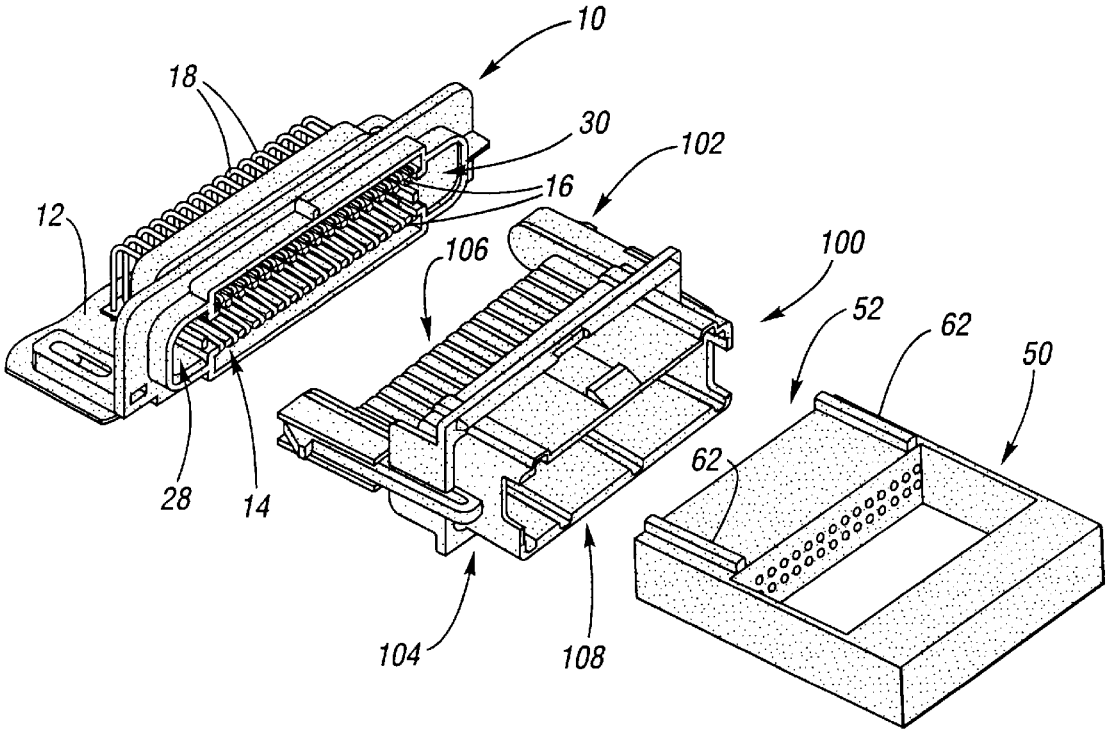
FIG. 5 is an exploded perspective view of an adapter according to the present invention for mating at a first end thereof to the flex-terminal of FIG. 1 and for mating at a second end thereof to the barrel-terminal receptacle of FIG. 3.

Referring now to the Drawings, FIGS. 5 through 12 generally depict various aspects of the adapter 100 according to the present invention. As can be seen by reference to FIG. 5, the adapter 100 has an adapter body 100*a* characterized by a first end 102 and an opposite second end 104, wherein the first end is configured in the form of an inlaid pin terminal receptacle 106, and wherein the second end is configured in the form of a projecting pin terminal receptacle 108. Although it is impossible for a flex-terminal receptacle 14 to be directly mated to a barrel-terminal receptacle 52, nonetheless, the flex-terminal receptacle is matable to the inlaid pin terminal receptacle 106 at the first end 102 and the barrel-terminal receptacle is matable to the projecting pin terminal receptacle 108 at the second end 104, wherein electrical connection within the adapter 100 between the inlaid pin terminal receptacle 106 and the projecting pin terminal receptacle 108 provides electrical contact between the flex-terminal receptacle 14 and the barrel-terminal receptacle 52.

Referring now additionally to the remaining FIGS. 6 through 12, the adapter 100 will be detailed structurally and functionally with greater specificity.

Figure 8:
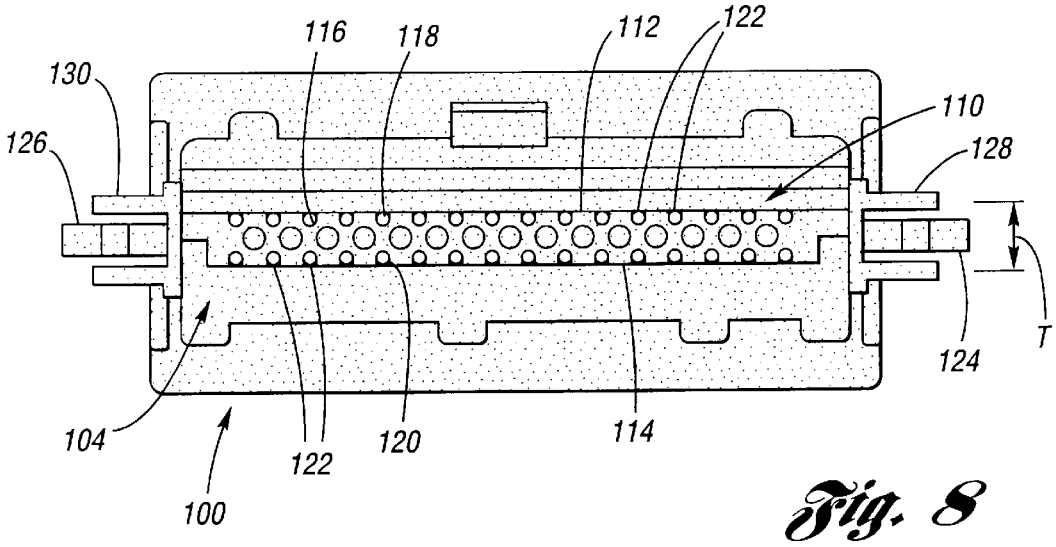
FIG. 8 is a side view of the first end of the adapter according to the present invention.
Figure 9:
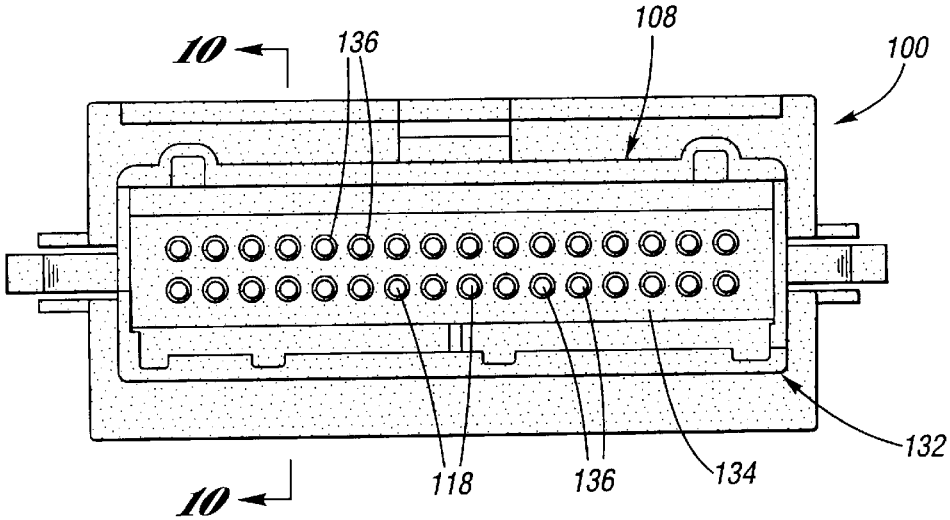
FIG. 9 is a side view of the second end of the adapter according to the present invention.
Figure 10:
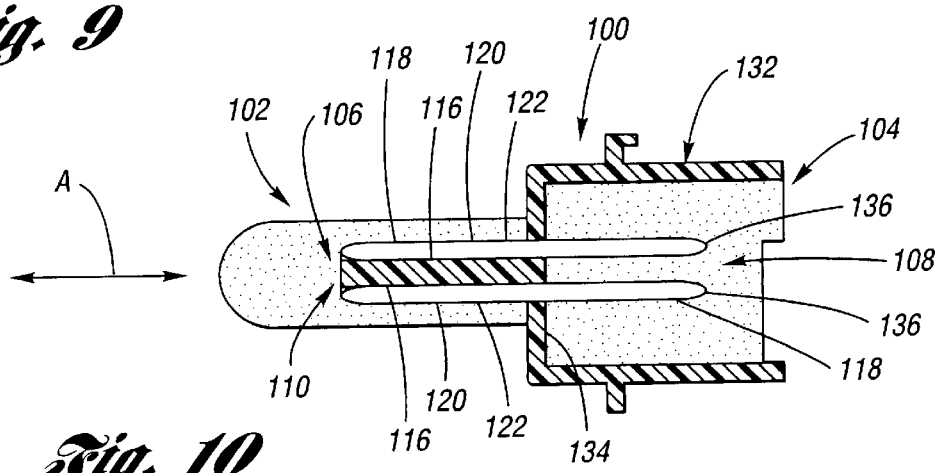
FIG. 10 is a partly sectional view of the adapter according to the present invention, seen along line 10—10 in FIG. 9.

The inlaid pin terminal receptacle 106, includes a rectangularly shaped base plane 110 having a thickness T between the upper and the lower sides 112, 114 thereof (see FIG. 8). A plurality of pin slots 116 are formed at each of the upper and lower sides 112, 114, wherein each pin slot is oriented parallel to the adapter axis A (see FIG. 10). Inlaid in each pin slot 116 is a pin 118 forming thereat an inlaid pin terminal 120, wherein an exposed contact surface 122 thereof lies at the respective upper or lower side 112, 114 of the base plane 110.

The thickness T of the base plane 110 is greater than the distance D between the relaxed position of the apices 32 of rowably opposing flex-terminals of the flex-terminal receptacle 14 to which the inlaid pin terminal receptacle 106 is intended to be mated, yet is less than the width W between of the inner faces 34, 36 thereof. Each pin slot 116 is positioned so that the exposed contact surface 122 thereof is contactably interfaceable with the apex 32 of a respective flex-terminal 16 of the flex-terminal receptacle 14. Accordingly, the inlaid pin terminal receptacle 106 of the first end 102 of the adapter 100 is both electrically and structurally connectable with a flex-terminal receptacle 14.

Figure 6:
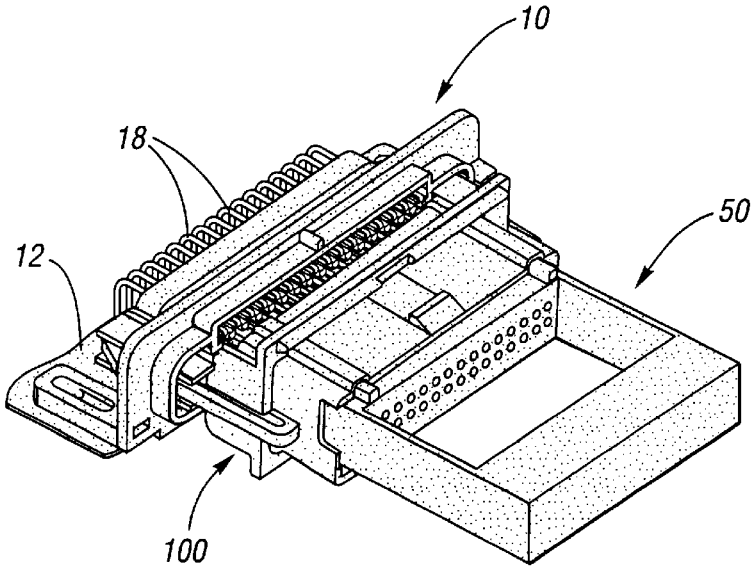
FIG. 6 is a perspective view of the adapter according to the present invention mated at the first end thereof to the flex-terminal of FIG. 1 and mated at the second end thereof to the barrel-terminal receptacle of FIG. 3.
Figure 7:
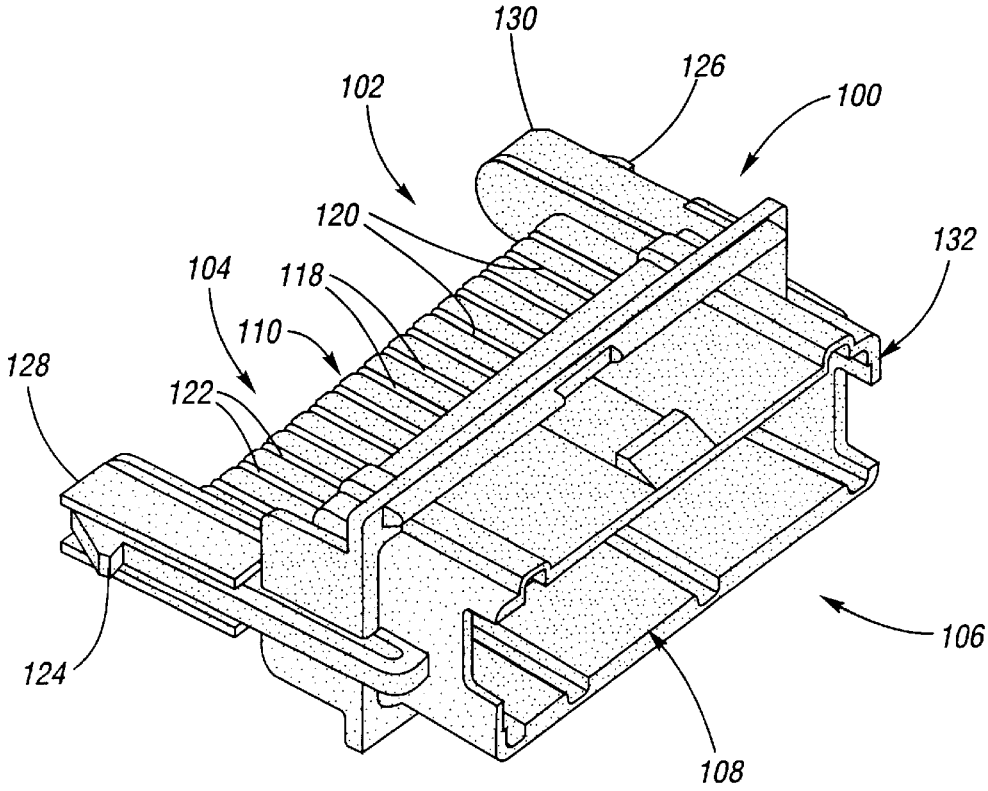
FIG. 7 is a perspective view of the adapter according to the present invention.
Figure 11:
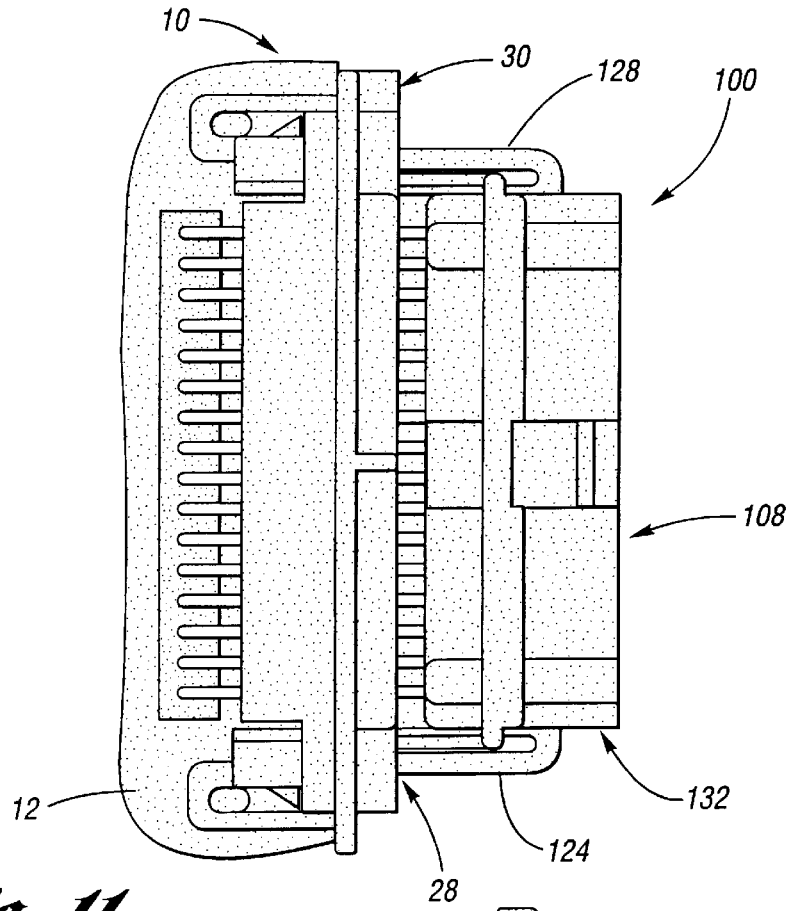
FIG. 11 is a top plan view of the adapter according to the present invention mated to the housing assembly of FIG. 1 via its associated flex-terminal receptacle.

In the preferred form of the adapter 100, the rear end 102 includes a pair of flexible lock arms 124, 126, each being flexibly situated in a U-shaped guide member 128, 130, so that the adapter is lockable to the seats 28, 30 of a header assembly 10 of a flex-terminal receptacle 14 in a conventional manner (see FIGS. 6 and 11). Locking the adapter 100 to a flex-terminal receptacle 14 affords less susceptibility to damage of the flex-terminal receptacle during operations associated with a tester when the tester is connected with the second end 104 of the adapter.

Figure 12:
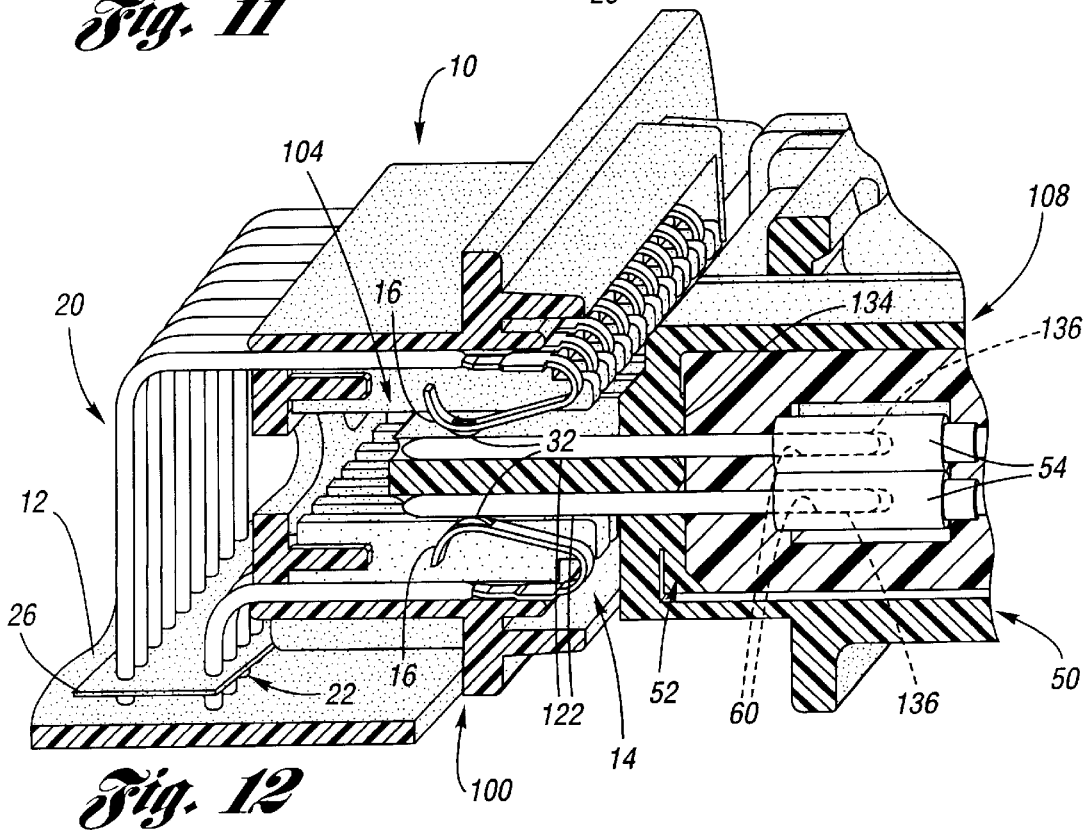
FIG. 12 is a partly sectional view of the adapter according to the present invention mated to the housing assembly of FIG. 1 via its associated flex-terminal receptacle.

The flex-terminal receptacle 14 is shown mated to the inlaid pin terminal receptacle 106 at FIGS. 6, 11 and 12.

The projecting pin receptacle 108 includes a shroud 132 which is dimensioned to snugly receive therein a barrel-terminal receptacle 52. Each pin 118 of each pin slot 116 passes through a dividing wall 134 of the adapter 100 and therefrom projects as a projecting pin terminal 136 within the shroud 132. The dividing wall 134 of the adapter body 100*a* serves to demarcate the inlaid pin terminal receptacle 106 from the projecting pin terminal receptacle 108. When a barrel-pin receptacle 52 is received into the shroud 132, each projecting pin terminal 136 is received into the central bore 60 of a respective barrel-terminal 54. The shroud 132 is provided with reciprocally placed indexing slots 138 for each receiving a respecting indexing rib 62 of the barrel-terminal receptacle 52.

In that a tester 50 includes a barrel-terminal receptacle 52, the tester is both electrically and structurally connectable to the second end 104 of the adapter via its projecting pin terminal receptacle 108, as shown at FIGS. 6 and 12.

With a flex-terminal receptacle 14 mated to the inlaid pin terminal receptacle 106 of the first end 102 of the adapter 100, and with a barrel-terminal receptacle 52 of a tester 50 mated to the projecting pin terminal receptacle 108 of the second end 106 of the adapter, the flex-terminals 16 of the flex-terminal receptacle are electrically connected to the barrel-terminals 54 of the barrel-terminal receptacle.

To those skilled in the art to which this invention appertains, the above described preferred embodiments may be subject to change or modification. Such change or modification can be carried out without departing from the scope of the invention, which is intended to be limited only by the scope of the appended claims.

What is claimed is:

1. An adapter for structurally and electrically connecting with both a flex-terminal receptacle and a barrel-terminal receptacle, comprising:

an adapter body having a first end and an opposite second end, wherein said first and second ends are demarcated by a dividing wall;

an inlaid pin terminal receptacle located at said first end, said inlaid pin terminal receptacle comprising a single base plane having a plurality of pin slots formed therein, wherein a pin is respectively located in a selected number of said pin slots, each pin forming an inlaid pin terminal at said base plane; and a projecting pin terminal receptacle located at said second end, said projecting pin terminal receptacle comprising a shroud, wherein each said pin projects through said dividing wall and forms within said shroud a freely and straightly projecting pin terminal;

wherein each pin is independent of each other pin.

2. The adapter of claim 1, further comprising lock arm means connected with said first end for selectively locking said first end to a flex-terminal receptacle.

3. The adapter of claim 1, further comprising indexing slots formed in said shroud.

4. The adapter of claim 1, wherein said base plane has an upper side and an opposite lower side; said plurality of pins comprising two parallel rows of pins, wherein an upper row of pins forms an upper row of inlaid pin terminals at said upper side of said base plane and forms an upper row of projecting pin terminals in said shroud, and wherein a lower row of pins forms a lower row of inlaid pin terminals at said lower side of said base plane and forms a lower row of projecting pin terminals in said shroud.

5. The adapter of claim 4, further comprising lock arm means connected with said first end for selectively locking said first end to a flex-terminal receptacle.

6. The adapter of claim 5, further comprising indexing slots formed in said shroud.

7. An adapter for structurally and electrically connecting a flex-terminal receptacle to a barrel-terminal receptacle, comprising:

an adapter body having a first end and an opposite second end, wherein said first and second ends are demarcated by a dividing wall;

an inlaid pin terminal receptacle located at said first end, said inlaid pin terminal receptacle comprising a single base plane having an upper side an opposite lower side, and a plurality of pin slots formed therein at each of said upper and lower sides, wherein a pin is respectively located in a selected number of said pin slots, each pin forming an inlaid pin terminal at said base plane; and a projecting pin terminal receptacle located at said second end, said projecting pin terminal receptacle comprising a shroud, wherein each said pin projects through said dividing wall and forms within said shroud a freely and straightly projecting pin terminal;

said plurality of pins comprising two parallel rows of pins, wherein an upper row of pins forms an upper row of inlaid pin terminals at said upper side of said base plane and forms an upper row of projecting pin terminals in said shroud, and wherein a lower row of pins forms a lower row of inlaid pin terminals at said lower side of said base plane and forms a lower row of projecting pin terminals in said shroud;

wherein each pin is independent of each other pin.

8. The adapter of claim 7, further comprising lock arm means connected with said first end for selectively locking said first end to a flex-terminal receptacle.

9. The adapter of claim 8, further comprising indexing slots formed in said shroud.

10. An electrical connection system comprising:

a flex-terminal receptacle having a plurality of V-shaped flex-terminals arranged in two rows;

a barrel-terminal receptacle having a plurality of barrel-terminals arranged in two rows; and an adapter electrically connecting said flex terminals to said barrel terminals comprising:

an adapter body having a first end and an opposite second end, wherein said first and second ends are demarcated by a dividing wall;

an inlaid pin terminal receptacle located at said first end, said inlaid pin terminal receptacle comprising a base plane having a plurality of pin slots formed therein, wherein a pin is respectively located in a selected number of said pin slots, each pin forming an inlaid pin terminal at said base plane which connects to a respective flex terminal; and a projecting pin terminal receptacle located at said second end, said projecting pin terminal receptacle comprising a shroud, wherein each said pin projects through said dividing wall and forms within said shroud a projecting pin terminal which inserts into a respective barrel terminal.

11. The electrical connection system of claim 10, further comprising lock arms connected with said first end for selectively locking said first end to said flex-terminal receptacle.

12. The electrical connection system of claim 10, wherein said barrel receptacle has a plurality of indexing ribs; and wherein said shroud has a plurality of indexing slots, each indexing rib being received in a respective indexing slot.

13. The electrical connection system of claim 10, wherein said base plane has an upper side and an opposite lower side; said plurality of pins comprising two parallel rows of pins, wherein an upper row of pins forms an upper row of inlaid pin terminals at said upper side of said base plane and forms an upper row of projecting pin terminals in said shroud, and wherein a lower row of pins forms a lower row of inlaid pin terminals at said lower side of said base plane and forms a lower row of projecting pin terminals.

14. The electrical connection system of claim 13, further comprising lock arms connected with said first end for selectively locking said first end to said flex-terminal receptacle.

15. The electrical connection system of claim 14, wherein said barrel receptacle has a plurality of indexing ribs; and wherein said shroud has a plurality of indexing slots, each indexing rib being received in a respective indexing slot.

* * * * *